United States Patent [19]

FitzSimons

[11] Patent Number: 4,537,529

[45] Date of Patent: Aug. 27, 1985

[54] EARTH RETAINING END ELEMENT FOR USE WITH OVERFILLED LOAD SUPPORT STRUCTURES

[76] Inventor: Louis N. FitzSimons, 10149 Cedar La., Kensington, Md. 20895

[21] Appl. No.: 590,799

[22] Filed: Mar. 19, 1984

[51] Int. Cl.[3] ..... E01F 5/00; E04B 1/32; E21D 11/00

[52] U.S. Cl. ..... 405/125; 405/124; 405/150; 52/86

[58] Field of Search ..... 405/124–126, 405/134–136, 150–152, 284, 286; 52/86, 88, 89, 169.1, 169.2, 169.4–169.6, 293–295

[56] References Cited

U.S. PATENT DOCUMENTS

| | | | |
|---|---|---|---|
| 262,402 | 8/1882 | Goodbridge | 405/125 |
| 538,432 | 4/1895 | Nichols . | |
| 567,653 | 9/1896 | Parker | 405/125 |
| 722,247 | 3/1903 | Ohaver | 405/125 |
| 786,059 | 3/1905 | Simpson . | |
| 950,928 | 3/1910 | Lana | 405/125 |
| 995,659 | 6/1911 | Burns . | |
| 997,382 | 7/1911 | Foster . | |
| 1,638,428 | 8/1927 | Zander . | |
| 1,850,335 | 3/1932 | Spindler . | |
| 2,126,091 | 8/1938 | Claybaugh | 405/124 |
| 2,636,352 | 4/1953 | Alger . | |
| 3,482,406 | 12/1969 | Schuppisser et al. | 405/124 X |
| 4,297,817 | 11/1981 | Bullock et al. . | |
| 4,336,674 | 6/1982 | Weber . | |

FOREIGN PATENT DOCUMENTS

| | | | |
|---|---|---|---|
| 51813 | 12/1966 | Fed. Rep. of Germany | 405/124 |
| 2084227 | 4/1982 | United Kingdom | 405/124 |

*Primary Examiner*—Cornelius J. Husar
*Assistant Examiner*—Nancy J. Stodola
*Attorney, Agent, or Firm*—Terry M. Gernstein

[57] ABSTRACT

An end element (10) retains earth overfill (E) associated to an overfilled load support structure (L) which includes an end arch element (S). The end element replaces a spandrel wall (R) and wingwalls (W), and includes a lateral extension (12) located next to the end arch element of the load support structure and which extends far enough so the slope of the fill between an overpass (O) and the toe (22) of the fill located on top of the support structure is low for permitting the overfill located on top of the load support structure to be essentially unrestrained in the horizontal direction. Retaining panels (14) are located adjacent to the lateral extension and cooperate with that lateral extension for retaining the fill.

9 Claims, 3 Drawing Figures

EARTH RETAINING END ELEMENT FOR USE WITH OVERFILLED LOAD SUPPORT STRUCTURES

DESCRIPTION

1. Technical Field

The present invention relates in general to load support structures, and more particularly to overfilled load support structures used in highway bridges, tunnels, and the like.

2. Background Art

Overfilled load support structures, such as disclosed in U.S. Pat. No. 3,482,406, can be used in highway bridges, tunnels, underground parking facilities or the like, and generally include one or more elements mounted on foundations and covered with a specified amount of earth overfill. The elements can be reinforced cementitious material which is cast-in-place at the construction site, or pre-cast and shipped to the site as required. Often, the earth overfill adjacent to the elements must be sloped to a degree such that it is not self-supporting and must be retained, especially on top of the structure. In such cases, an earth retaining means such as a spandrel wall is located at each end of the load support structure to close the area between the exterior of the load support structure elements, the side extremities and an upper traffic route surface for retaining overfill.

Such earth retaining walls permit use of highly sloped overfill embankments, but must, themselves, be supported to prevent sliding or overturning. Some support is obtained using tiebacks which attach the spandrel wall to the load support structural elements; however, for large structures encountered in highway construction, more than tiebacks can be required to support a spandrel wall. This additional support is generally provided by a pair of wingwalls mounted on the support structure foundation to extend along the sides of the underpass. The wingwalls are also generally reinforced concrete which is cast-in-place or pre-cast. Each of the wingwalls has a vertical edge in abutting contact with the spandrel wall to support that spandrel wall against horizontally directed pressure exerted on the spandrel wall by the earth overfill. A wingwall also can be used to retain earth overfill so that several additional wingwalls can be placed next to the spandrel wall supporting wingwalls to retain earth away from an underpass. Wingwalls generally have a sloped top edge, and the number of wingwalls employed is dependent on the type and height of load support structure as well as on the height of the spandrel wall and the earth overfill. Forming and erecting large elements creates problems in construction. Therefore, as a spandrel wall itself is a large element and requires further large elements, i.e., the wingwalls, a load support structure which uses a spandrel wall may have problems related to cost, erection procedures and schedules, as well as erection time.

One way to avoid these problems is to extend the load support structure far enough laterally so that the overfill can be safely sloped down to the top of the extended load support structure. However, the extra width of load support structure required for such result may be so great as to be impractical aesthetically, physically or economically, especially if extremely large reinforced concrete structures, high overpass routes or large headroom for the underpass are used. Furthermore, there may be advantages or requirements for keeping the overfill high, in which case, simply extending the structure far enough to permit the overfill to be totally unrestrained may not be possible for the just stated reasons. A further disadvantage of adding extra width results because there may be a great area of uncovered load support structure. In many overfilled load support structures, the overfill serves to distribute and support the load and to counteract excessive deformations of that support structure. Even if the extra width of load support structure is covered with overfill, extra earthwork will be required thereby creating extra costs and problems.

Other ways of deleting the spandrel wall may require extensive and difficult earthwork which may not be effective in reducing overall cost and difficulty of a project. Furthermore, in a particular situation, it may not be practical to design a bridge system which does not require suporting the overfill.

DISCLOSURE OF THE INVENTION

It is a main object of the present invention to provide a novel and improved overfilled load support structure which does not require an earth overfill spandrel wall but which remains practical for use.

It is another object of the present invention to provide a novel earth retaining end element for use with an overfilled load support structure without requiring a spandrel wall. However this lateral extension of the overfilled load support structure should not be so great as to be uneconomical.

It is another object of the present invention to provide a novel overfilled load support structure which includes a plurality of arch-shaped pre-cast, reinforced concrete elements.

It is another object of the present invention to provide a novel end element for use with an overfilled load support structure which replaces the earth overfill spandrel wall and wingwalls in a manner that is both effective and practical. The end element includes an extension of the load support structure which is long enough to permit the earth overfill on top of the extension to be essentially unrestrained in the horizontal direction but which is not so long as to permit this overfill to be completely unrestrained. Therefore, the extension remains within practical limits. As the extension is shorter than is required to permit all of the overfill located on top of and adjacent to the load structure to be completely unrestrained, the present end element includes a retaining panel which is located adjacent to the extension to provide enough support to the overfill to prevent horizontal movement of that overfill adjacent to the load support structure. The extension is long enough so that no further support is required for the retaining panel, so that retaining panel can be shorter than the load support structure. Materials and the like can be saved thereby making the present end extension less expensive than an overfill retaining means which includes a spandrel wall and wingwalls.

These and other objects are accomplished by an end element for use with an overfilled load support structure having a arch extending upwardly from foundation level. The end element retains earth fill and replaces a spandrel wall and wingwalls. The end element includes a lateral extension for widening the load support structure sufficiently to permit the fill to have a slope of less than about 40 degrees for permitting essentially unrestrained positioning of the fill on the widened load support structure. This end element also resists horizontal earth pressure. Due to the low slope of the fill resulting from the extension of the load support structure, the retaining panels need not be as tall as a retaining wall, such as a spandrel wall. However, because the retaining panels resist horizontal movement of the earth fill adjacent to the load support structure, the lateral extension need not be impractically wide. The retaining panels therefore retain the earth fill in an economical, practical manner. The retaining panels are spaced from the lateral extension of the arch and have a height less than about ⅔ of the height of the load support structure. The lateral extension can be shaped identically with the load support element for ease of manufacture, and can be arch-shaped when used in conjunction with a load support structure comprising arch-shaped elements. Each of the retaining panels includes an end edge shaped to match the lateral extension and a base which is sized so that vertical forces exerted thereon are adequate to prevent sliding or overturning of the retaining panel.

BEST MODE FOR CARRYING OUT THE INVENTION

Figure 1:
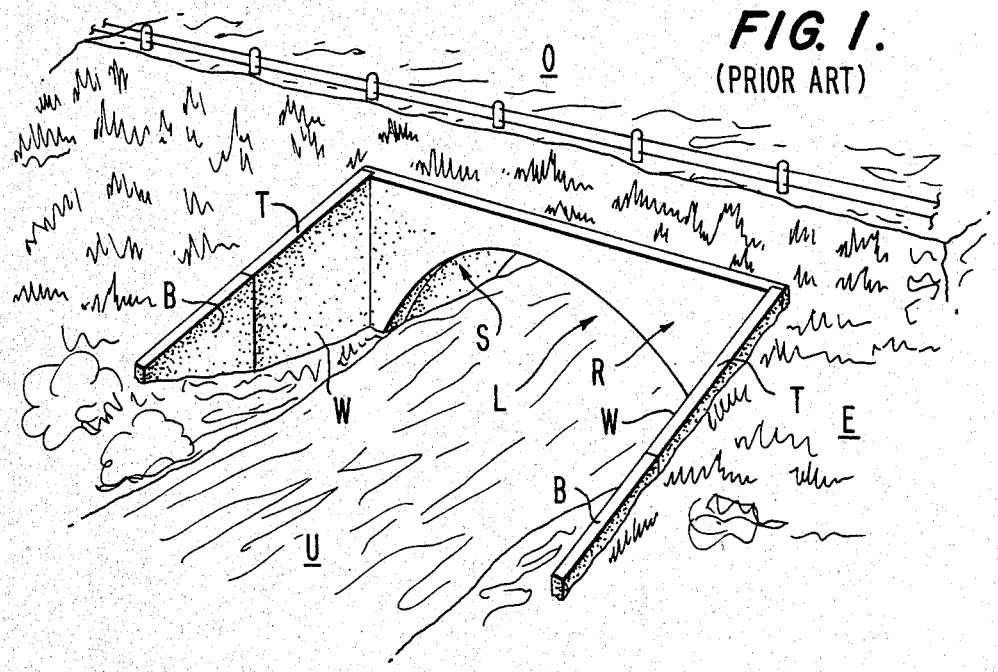
FIG. 1. (PRIOR ART)
FIG. 1 is a perspective of an overfilled load support structure used with an overfill spandrel wall and wingwalls according to the prior art.

As shown in FIG. 1, an underpass U, such as a highway, a footpath, a railway, a river, or the like, is located below an overpass O, which can be a highway, a railway, traffic route, or the like. As shown, a load support structure L spans the underpass and includes a plurality of arch-shaped elements such as end arch S, which are formed of pre-cast reinforced cementitious material and are supported on a foundation (not shown) to curve upwardly from ground level. The load support structure is of the overfilled type, and thus earth overfill E having a slope which can be infinite in certain locations is located adjacent to the structure.

As shown in FIG. 1, the load support structure of the prior art requires an earth overfill retaining means such as a spandrel wall R, to retain the earth overfill E over the load support structure. The retaining wall is located adjacent to end shell S of the load support structure and wingwalls W, having sloping top edges T are located adjacent to the spandrel wall both to support the spandrel wall and to retain earth overfill away from the underpass. Additional wingwalls B can be included to retain earth, with the number of wingwalls B used being dependent on the height of spandrel wall.

Figure 2:
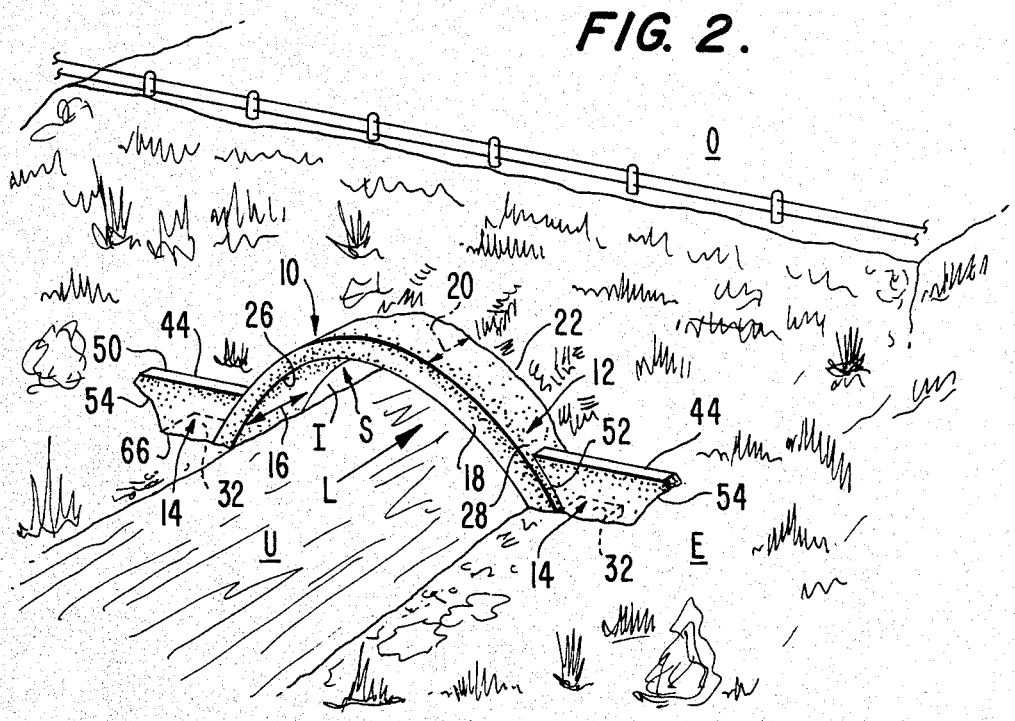
FIG. 2 is a perspective of the earth retaining end element of the present invention used in conjunction with an overfilled load support structure.

Shown in FIG. 2 is an end element 10 of the present invention. The end element retains earth overfill adjacent to load support structure L without requiring use of a spandrel wall or wingwalls. End element 10 includes a lateral extension 12 and retaining panels 14 which work in conjunction with each other to retain earth fill adjacent to support structure L in an economical and practical manner.

Lateral extension 12 is shaped to match the arches used in load support structure L, and is located adjacent to end arch element S. As a matter of economy, the lateral extension can be an arch used in the load support structure, such as arch element S, and can be mounted on a continuation of the foundation used in conjunction with the load support structure. The extension 12 has a width which is indicated by dimension arrow 16 extending between a rear end of the extension and front rim 18. Extension 12 forms a continuation of load support structure L out of the earth overfill for a predetermined distance indicated in FIG. 2 by dimension arrow 20 extending between toe 22 of the overfill and outer rim 18 of the lateral extension 12.

The lateral extension 12 is selected so that for the relative locations of underpass U and overpass O and the vertical distance between load support structure L and overpass O, the horizontal distance between the overpass and the and rim 18 is long enough for the earth overfill E between the overpass and toe 22 to have a slope of about thirty to forty degrees in the vicinity of the load support structure L and end element 10, with the particular slope being selected so that the fill at toe 22 on end element 10 can be essentially unrestrained in the horizontal direction. If conditions permit, a plurality of lateral extensions 12 can be used, and preferably the extension 12 includes an inner surface 26 matching inner surface I of the load support elements and an outer surface 28 matching the outer surface (not shown) of the load support structure elements.

Retaining panels 14 are mounted adjacent to the lateral extension 12 and retain fill for preventing horizontal movement of that fill toward rim 18. The retaining panels 14 provide lateral stability to the fill and permit lateral extension 12 to be shorter than would be required if the fill were completely unrestrained. However, due to the presence of lateral extension 12, the retaining panels 14 are not required to support as much fill as a retaining wall. Thus, lateral extension 12 need not be impractically long, yet retaining panels 14 need not be supported by elements such as wingwalls W, and are not as large as a retaining wall. The end element 10 even including the earthwork required to establish the desired slope, thus is less expensive to form and erect than an overfill retaining system which includes a spandrel wall R and wingwalls W.

Figure 3:
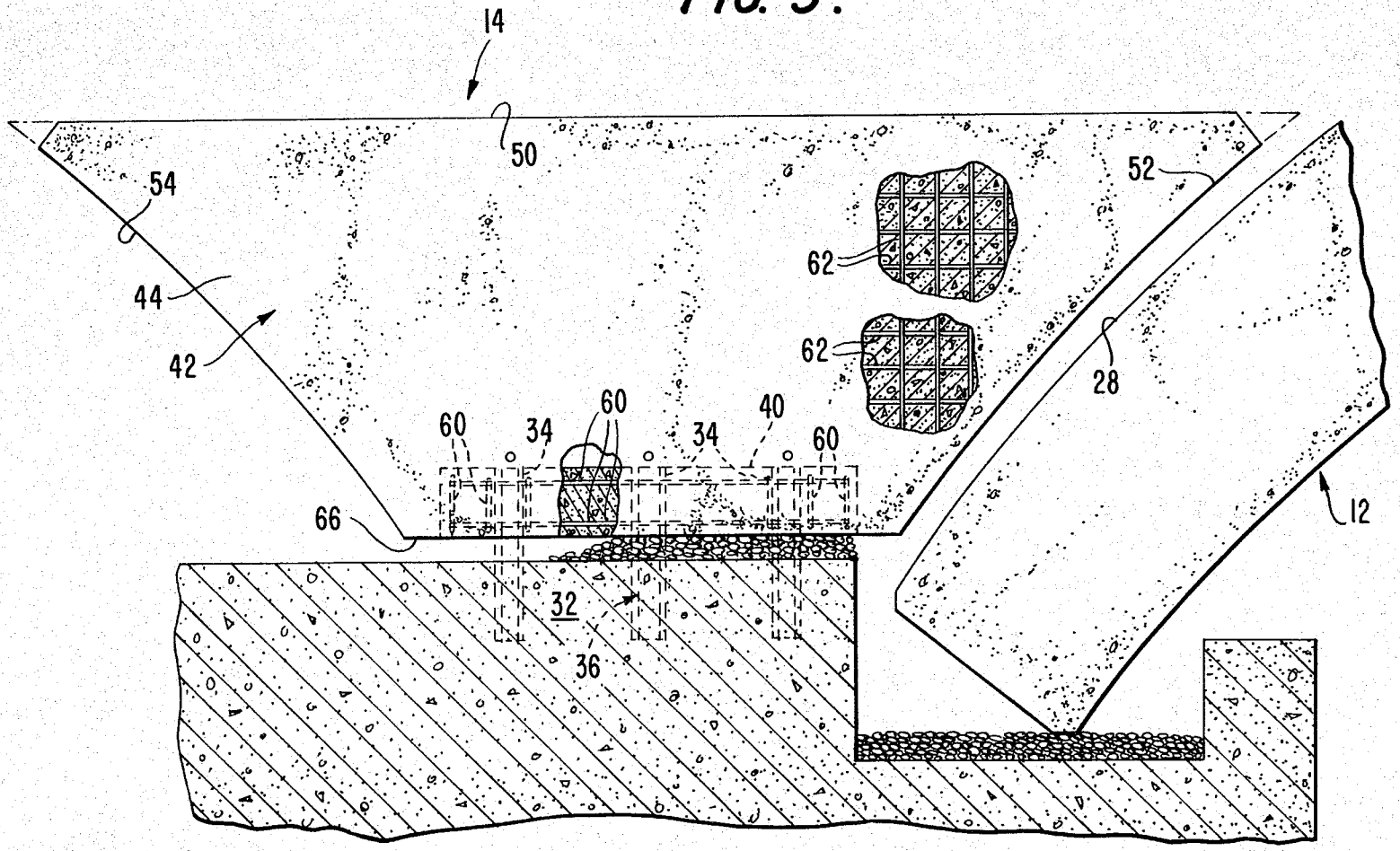
FIG. 3 is an elevation view of a retaining panel included in the end element of the present invention.

A retaining panel 14 is best shown in FIG. 3 as including a base 32 having bores 34 defined therein for receiving fastening elements, such as dowels 36, which are used to affix retaining panel 14 to a footing 38. Base 32 is buried in the fill and is sized so that sliding or overturning of the retaining panel 14 is prevented by the combined effect of the fastening means and the vertical component of the fill weight acting on upper surface 40 of the base. Each retaining panel 14 further includes a body 42 having a rear surface 44 against which fill bears, and a top edge 50 which is horizontal when the retaining panel is mounted in place and extends between an inner edge 52 and an outer edge 54. Inner edge 52 is shaped to match the shape of lateral extension 12, and is the case of an arch-shaped element extension, inner edge 52 is accurate as shown. Inner edge 52 is spaced from the lateral extension a distance sufficient to permit non-destructive movement of the lateral extension. The area between inner edge 52 and lateral extension 12 can be sealed as suitable to prevent material from passing into and through that area.

INDUSTRIAL APPLICABILITY

The end extension 10 is most useful when used with an arch-shaped load support system such as disclosed in U.S. Pat. No. 3,482,406 and manufactured in accordance with specifications and requirements associated with BEBO of America, Inc. of Kensington, Md., or BEBO-International Heierli & Co of Zurich, Switzerland. Such arches can be from two to twenty feet in rise, twenty to fifty feet in span and two to twelve feet in width and can weigh more than ten tons, and are generally pre-cast reinforced concrete. However, other load support structures and shapes, and retaining means other than spandrel walls can be used without departing from the scope of the present disclosure. The panels 14 can be any suitable shape and formed of pre-cast concrete, and the base 32 and body 42 can include reinforcing bars 60 and 62 respectively; however, retaining panels 14 can also be cast in place if suitable. The body 42 can be of any suitable size and shape, with a height as measured between lower edge 66 and top edge 50 being less than the height of lateral extension 12 as measured from the foundation the crown, or the highest point on the arch soffit. The height of body 42 is preferably between about $\frac{1}{3}$ and $\frac{2}{3}$ of the height of the lateral extension. The height of retaining panel 14 is therefore less than the height of a spandrel wall, so base 32 can support the retaining panel position without requiring additional elements, such as wingwalls W, or the like. A low collar may also be used on the lateral extension adjacent to outer rim 18 to direct drainage laterally and to prevent loose overfill from falling onto underpass U.

I claim:

1. An earth retaining end element for retaining earth overfill adjacent to an overfilled load support structure, with the load support structure including an arch element extending upward from foundation level, comprising:

(A) a longitudinal extension means having a crown and extending longitudinally from the arch element out of the earth overfill so that the earth overfill forms a toe on top of said longitudinal extension means, with said toe being unrestrained in at least one horizontal direction for permitting essentially unrestrained support of earth overfill on top of the; longitudiinal extension means and (B) a retaining panel means having a height less than the height of the extension means crown above the foundation level and being located adjacent to said longitudinal extension means, said retaining panel means being spaced longitudinally from the arch element to contact the earth overfill at locations spaced from the arch element and resisting horizontal earth pressure at locations spaced from the top of the arch element for resisting horizontal movement of the earth overfill located adjacent to the arch element, whereby the earth overfill is supported without using a spandrel wall or wingwalls.

2. The earth retaining end element defined in claim 1 wherein said retaining panel means is spaced from said longitudinal extension means a distance far enough to permit a predetermined amount of movement of said longitudinal extension means.

3. The earth retaining end element defined in claim 1 wherein said longitudinal extension means includes an arch shaped element which forms a continuation of the load support arch element.

4. The earth retaining end element defined in claim 3 wherein the load support structure includes a plurality of pre-cast reinforced concrete arch-elements and said retaining panel means includes an end edge curved to match the curvature of said arch shaped longitudinal extension means, said end edge being spaced laterally from said longitudinal extension means to define a gap between said longitudinal extension means and said retaining panel means to permit non-destructive movement of said longitudinal extension means.

5. The end element defined in claim 5 wherein said retaining panel means has a height less than about $\frac{2}{3}$ the height of the extension means crown.

6. The end element defined in claim 5 wherein said longitudinal extension means extends from an adjacent arch element far enough to limit the slope of the earth overfill next to said extension means to less than about 40 degrees.

7. The end element defined in claim 1 wherein said retaining panel means includes a base means which is buried in the earth overfill for preventing overturning of said retaining panel means by the earth overfill.

8. An end element for use with an overfilled load support structure which includes an arch element of pre-cast reinforced cementitious material having an inner surface and extending upwardly from a foundation plane and an outer surface, comprising:

(A) an end means longitudinally extending out of the earth overfill so the earth overfill forms a toe on top of said end means, with said toe being unrestrained in at least one horizontal direction, said end means including:

(1) an inner surface having a shape matching the arch element inner surface and, (2) an outer surface having a shape matching the shape of the arch element outer surface, and (B) an earth retaining means for retaining earth fill adjacent to said end means, said earth retaining means being spaced longitudinally away from the arch element and being mounted adjacent to said end means outer surface and including a body means for resisting horizontal earth pressure directed longitudinally of said end means, said earth retaining means having a height less than the height of said end means said body means including an inner end edge located closely adjacent to said end means outer surface and extending outwardly from said end means outer surface for retaining the earth fill adjacent to the load support structure.

9. An end element for use with an overfilled load support structure which includes an arch element of pre-cast reinforced cementitious material and extending upwardly from a ground plane having an inner surface and an outer surface on which earth fill is supported when the arch element is mounted in place, comprising:

(A) an end means extending longitudinally out of the earth overfill and from the arch element, the earth overfill on top of said end means forming a toe which is unrestrained in at least one horizontal direction, said end means extending from the arch element far enough so that the earth overfill has a slope less than about 40 degrees, said end means including:

(1) an inner surface having a shape matching the shape of the arch element inner surface, and (2) an outer surface having a shape matching the shape of the arch element outer surface, and (B) a retaining panel means for retaining earth fill adjacent to said end means, said retaining panel means being spaced longitudinally from the end of the arch element and being located adjacent to and laterally spaced from said end means outer surface and including a body means for resisting horizontal earth pressure directed longitudinally of said end means, wherein said body means extends upwardly from the ground plane and includes a top edge located to be no higher than the maximum height of the arch element above the foundation plane, said body means also extending laterally outward from said end means outer surface for retaining the earth fill adjacent to the load support structure whereby the earth overfill is supported without a spandrel wall or wingwalls.

* * * * *